United States Patent [19]

Thimon

[11] Patent Number: 5,040,359

[45] Date of Patent: Aug. 20, 1991

[54] METHOD AND MACHINE FOR BANDING A PALLETIZED LOAD

[75] Inventor: Jacques Thimon, St. Louis, Mo.

[73] Assignee: Newtec International (Societe Anonyme), Aix-Les Bains, France

[21] Appl. No.: 559,258

[22] Filed: Jul. 30, 1990

[30] Foreign Application Priority Data

Aug. 2, 1989 [FR] France ..... 89 10435

[51] Int. Cl.[5] ..... B65B 13/04; B65B 41/16

[52] U.S. Cl. ..... 53/556; 53/588; 53/389.4

[58] Field of Search ..... 53/556, 587, 588, 211, 53/389.3, 389.4

[56] References Cited

U.S. PATENT DOCUMENTS

| | | | |
|---|---|---|---|
| 4,050,221 | 9/1977 | Lancaster, III et al. | 53/211 |
| 4,109,495 | 8/1978 | Shulman | 53/588 X |
| 4,173,108 | 11/1979 | Eglinton | 53/587 |
| 4,204,377 | 5/1980 | Lancaster et al. | 53/399 |
| 4,235,062 | 11/1980 | Lancasater, III et al. | 53/399 |
| 4,255,918 | 3/1981 | Lancaster et al. | 53/556 |
| 4,271,657 | 6/1981 | Lancaster, III et al. | 53/399 |
| 4,302,920 | 12/1981 | Lancaster et al. | 53/399 |
| 4,336,679 | 6/1982 | Lancaster et al. | 53/399 |
| 4,387,548 | 6/1983 | Lancaster et al. | 53/399 |
| 4,387,552 | 6/1983 | Lancaster et al. | 53/556 |
| 4,418,510 | 12/1983 | Lancaster, III et al. | 53/399 |
| 4,587,796 | 5/1986 | Haloila | 53/588 |
| 4,912,911 | 4/1990 | Dodd | 53/587 |

FOREIGN PATENT DOCUMENTS

| | | |
|---|---|---|
| 0177413 | 4/1986 | European Pat. Off. . |
| 0220712 | 5/1987 | European Pat. Off. . |
| 0110751 | 1/1988 | European Pat. Off. . |
| 2281275 | 3/1976 | France . |
| 2417167 | 8/1980 | France . |
| 2468506 | 5/1981 | France . |
| 2489780 | 3/1982 | France . |
| 2505775 | 11/1982 | France . |
| 2535297 | 1/1985 | France . |
| 2470056 | 5/1986 | France . |
| 2571656 | 11/1986 | France . |
| 2571655 | 2/1987 | France . |
| 2572359 | 9/1987 | France . |
| 2014107 | 8/1979 | United Kingdom . |
| 2137964 | 10/1984 | United Kingdom . |

*Primary Examiner*—John Sipos

*Attorney, Agent, or Firm*—Body, Vickers & Daniels

[57] ABSTRACT

In a banding machine of the fixed-table and pivoting reel of film type, a mechanism is provided for deviating and vertically offsetting the downstream, delivered section of the band of film which is actuated during banding, from a state in which deviation and offset are minimal to a condition where the band of film applied to the load is off-set vertically with respect to the reel of film whereby wrinkling of the film is avoided at the lowermost portion of the load.

22 Claims, 8 Drawing Sheets

METHOD AND MACHINE FOR BANDING A PALLETIZED LOAD

The invention relates to a method and a machine for helically banding a palletized load with a band of stretchable plastic film.

Machines of this type are already known (documents EP 0,177,413, 0,220,712, U.S. Pat. Nos. 4,109,445 and 4,587,796 or machine marketed by the NEWTEC INTERNATIONAL Group under the name ("DRAPAL OCTOPUS") comprising a stand, a table supporting the load in a fixed position during the banding of the load and with which supply means and removal means for the load (such as roller conveyors) can be combined; a moveable carriage supporting a reel of film having an axis with a generally vertical direction; mechanical means for supporting and guiding the carriage, which means are carried by the stand, such that the carriage may be displaced in a displacement resulting from the combination of an ascending and/or descending vertical displacement and of a displacement in a horizontal loop surrounding the load; and carriage-drive means capable of ensuring its effective displacement, in particular in an at least substantially helical path, about a vertical axis, surrounding the load with a view to banding it with the band of film.

The mechanical means for supporting and guiding the carriage may form the subject of several alternative embodiments: rotating arm (documents EP 0,177,413, EP 0,220,712 and U.S. Pat. No. 4,109,445) or horizontal frame, surrounding the load, moveable in the vertical direction and along which the carriage is displaced (document U.S. Pat. No. 4,587,796).

In a possible alternative, the machine is not automatic (document U.S. Pat. No. 4,109,445), and in this case the initial fastening of the band of film onto the load, the final transverse cutting of the band of film and the combination of the last end part of the band of film with the banded load are performed manually. In another alternative, these operations are carried out automatically, the banding machine being automatic and having for this purpose, carried by support means, means for transversely cutting the band of film which are activated at the end of the banding of the load; means for temporarily storing the first end part of the band of film originating from the reel of film, which means are active before the banding operation has begun; means for combining the last end part of the band of film with the banded load, which means are active at the end of the banding operation; and means for controlling and operating the cutting means, the securing means and the combining means (documents EP 0,177,413 and U.S. Pat. No. 4,587,796).

It is possible, using machines of this type, to perform a helical banding of the vertical side faces of a palletized load and in order to do so a load to be banded is supplied and placed on the support table in a fixed position; the first end part of the band of film originating from the reel of film is secured against a vertical face of the load; with the load remaining stationary at all times, the reel of film is displaced about the load and the reel of film is consequently unwound and the load banded with the band of film originating from the reel, the feed rate of film being determined so as to be appropriate for the type of banding performed; in this way, at least one turn of the band of film is formed on the load; the band of film is cut transversely; the last end part of the band of film is combined with the banded load; and on the one hand the new first end part of the band of film is secured, and on the other hand the banded load is removed so as to be able to commence a new banding procedure with a different load.

According to a known operating procedure, a helical banding operation is carried out with the reel of film being in the lowermost position at the beginning of the banding procedure, in other words in its relative position closest to the table in the vertical direction; the reel of film is then displaced in an ascending helical movement around the load and until the band of film covers its vertical side faces. A descending helical movement of the reel of film is then performed in order to form a second layer of the band of film covering and crossing over the first layer formed during the ascending helical banding, and this continues until the reel of film resumes its initial position in the lowermost position.

The method and the machine described above in a general manner may form the subject of alternative embodiments or improvements.

Firstly, this technology is preferably employed with a stretchable film, preferably stretched beyond, in particular considerably beyond, the elastic limit in order to subsequently create, once applied to the load, compressive forces and forces maintaining the cohesion of the load. This technology may, however, also be employed with a non-stretchable film, in particular a heat-shrinkable film. The film may be solid or perforated, in that case forming a net. It may have a reasonably large breadth. The banding may be continuous, all the turns of film covering each other, or discontinuous, some zones of the load remaining free (see in particular documents FR 2,505,775, U.S. Pat. No. 4,204,377, U.S. Pat. No. 4,235,062). The method and the machine function manually, semi-automatically or automatically.

As for the operating procedure using a stretchable film pre-stretched before being applied to the load, a motorized or non-motorized pre-stretching device is employed having two upstream and downstream rollers or having a single roller, as is apparent from the documents FR,2,281,275, FR 2,468,506, FR 2,470,056, FR 2,489,780, FR 2,571,655, FR 2,571,656, as well as the known existence of a pre-stretching device known under the name of "DYNA-DRAPEUR" marketed by the companies of the NEWTEC INTERNATIONAL Group, and of a pre-stretching device "VARISTRETCH" from MULLER MANUFACTURING INC.

Furthermore, the machine may also have, carried by the stand, a pressure plate mounted so as to be able to be raised or lowered by way of drive means and freely pivotable about its vertical axis, driven pivotably by the load when it is applied to its upper horizontal face; a pinching tool for gripping the film, which may be opened and closed and withdrawn as a unit by way of drive means, which pinching tool is carried by the table, or the carriage, or the pressure disk; and combined with the pinching tool; means for transversely cutting the film and/or means for fastening the film to itself or to the load (see in particular documents U.S. Pat. Nos. 4,255,918, 4,271,657, 4,336,679, 4,387.548, 4,387,552, 4,418,510, 4,050,221, 4,302,920, FR 2,416,167, EP 0,110,751, FR 2,535,297, FR 2,572,359, GB 2,014,107).

One of the problems which arises with this type of machine (referred to as the fixed-table and pivoting reel of film type) is that some of its moving components interfere with other moving components or stationary components. For example, the carriage which supports the reel of film must be at a sufficient distance in the vertical direction above the support table for it (and the means which it supports, as well as the film) not to interfere with the support table and/or with the supply means and the removal means for the load (conveyors) which extend vertically up to a certain level. Similarly, the mechanical means for supporting and guiding the carriage, the carriage and the band of film originating from the carriage must not interfere in an untimely and undesired manner with the transverse-cutting means, the temporary-securing means and the combining means.

If reference is made to the document EP 0,220,712, it can be seen that the reel of film is initially very substantially offset in the vertical direction and upwards relative to the lower horizontal face or to the lower horizontal edge of the palletized load defined by the load-support pallet or by the table supporting the palletized load. Also, the band of film originating from the reel of film is seized by a gripping device situated beneath the reel of film, which results in the band of film situated between this gripping device and the reel of film being wrinkled irregularly and, as a consequence, an unsatisfactory banding of the film in the lower part of the palletized load when it is this very area of the load which should receive a banding of excellent quality, both for mechanical reasons to do with the load and for protection against impacts, etc.

The main object of the invention is therefore to propose a banding method and machine of the abovementioned type (fixed table and pivoting reel of film) in which the banding performed on the lower part of the load is of an excellent quality, in particular extending as far as the lower edge of the load.

Moreover, another object of the invention is to propose a banding machine of the abovementioned type in which there is no untimely and undesired interference or risk of interference between the various components of the machine, in particular the fixed and moving components.

Lastly, another object of the invention is to propose a method and a machine of the abovementioned type in which it is possible to perform, also in the lowermost part of the load, a longitudinal pleating of the band of film—controlled, regular and non-random pleating—giving it the function of a cord.

Machines for packaging a palletized load are already known in which such a longitudinal pleating of the band of film is performed before it is applied to the load in the manner of a cord (in particular documents U.S. Pat. Nos. 4,204,377, 4,255,918 and 4,271,657). These devices are then, however, applied to a machine in which the load pivots and the carriage supporting the reel of film can move only in the vertical direction. Now such machines do not have the abovementioned limitation imposed on the machines of the type according to the invention since there is no risk of the film interfering with the support table or with the conveyors for supplying and removing the load.

To this end, the invention proposes a machine for helically banding the vertical side faces of a palletized load with a band of plastic film whose width is a fraction of the height of the load, which comprises a stand; a table supporting the load in a fixed position during the banding of the load and with which supply means and removal means for the load may be combined; a moveable carriage supporting a reel of film having an axis with a generally vertical direction; mechanical means for supporting and guiding the carriage which means are carried by the stand, such that the carriage may be displaced in a displacement resulting from the combination of an ascending and/or descending vertical displacement, and of a displacement in a horizontal loop surrounding the load; carriage-drive means capable of ensuring its effective displacement in an at least substantially helical path, about a vertical axis, surrounding the load with a view to helically banding it with the band of film.

According to the invention, this machine may have, firstly, in addition and in combination: means for deviating in its own plane the band of film originating from the reel of film, and for vertically offsetting the downstream delivered section of the band of film with respect to the reel of film, which means are on the one hand carried by the carriage at least substantially opposite the reel of film and on the other hand may be deformed during the banding between two extreme configurations corresponding to two separate extreme states, an active one in which they ensure the deviation and the maximum vertical offsetting and an inactive one in which the deviation and the offset are zero or minimal, respectively; and, secondly, means for controlling and driving the deviating and vertical-offsetting means in order to switch them from their active state to their inactive state or vice versa; such that in a certain relative situation of the carriage during the banding operation, the operation of the control and drive means results in the downstream delivered section of the band of film applied to the load being offset relatively in the vertical direction with respect to the reel of film. Secondly, this machine may furthermore comprise support means for means for transversely cutting the band of film, which means are activated at the end of the banding of the load; means for temporarily securing the first end part of the band of film originating from the reel of film, which means are active before the beginning of the banding operation; means for combining the last end part of the band of film with the banded loaded, which means are active at the end of the banding operation; and means for controlling and operating the cutting means, the securing means and the combining means; which support means are arranged so as to enable the cutting, securing and combining means to slide in the vertical direction, and are essentially placed beneath the means, between the latter and the level of the support table, which results in the space above the means being freed.

The invention also relates to a method for helically banding the vertical side faces of a palletized load with a band of plastic film whose width is a fraction of the height of the load, in which: a load to be banded is supplied and placed on a support table in a fixed position; the first end part of a band of film originating from a reel of film having an axis with a generally vertical direction is secured against a vertical face of the load; with the load remaining fixed, the reel of film is displaced around the load and consequently the reel of film is unwound and the load is banded with the band of film originating from the reel in this way, at least one turn of the band of film is formed on the load; the band of film is cut transversely; the last end part of the band of film is combined with the banded load; the new first end part of the band of film is secured and the banded load is removed; wherein, in at least one stage of the banding of the load with the band of film, the reel of film is displaced in a path in a horizontal loop and the band of film unwound from the reel is deviated in this stage and offset in the vertical direction.

The other features of the invention will appear from the following description made with reference to the attached drawings, in which.

Figure 1:
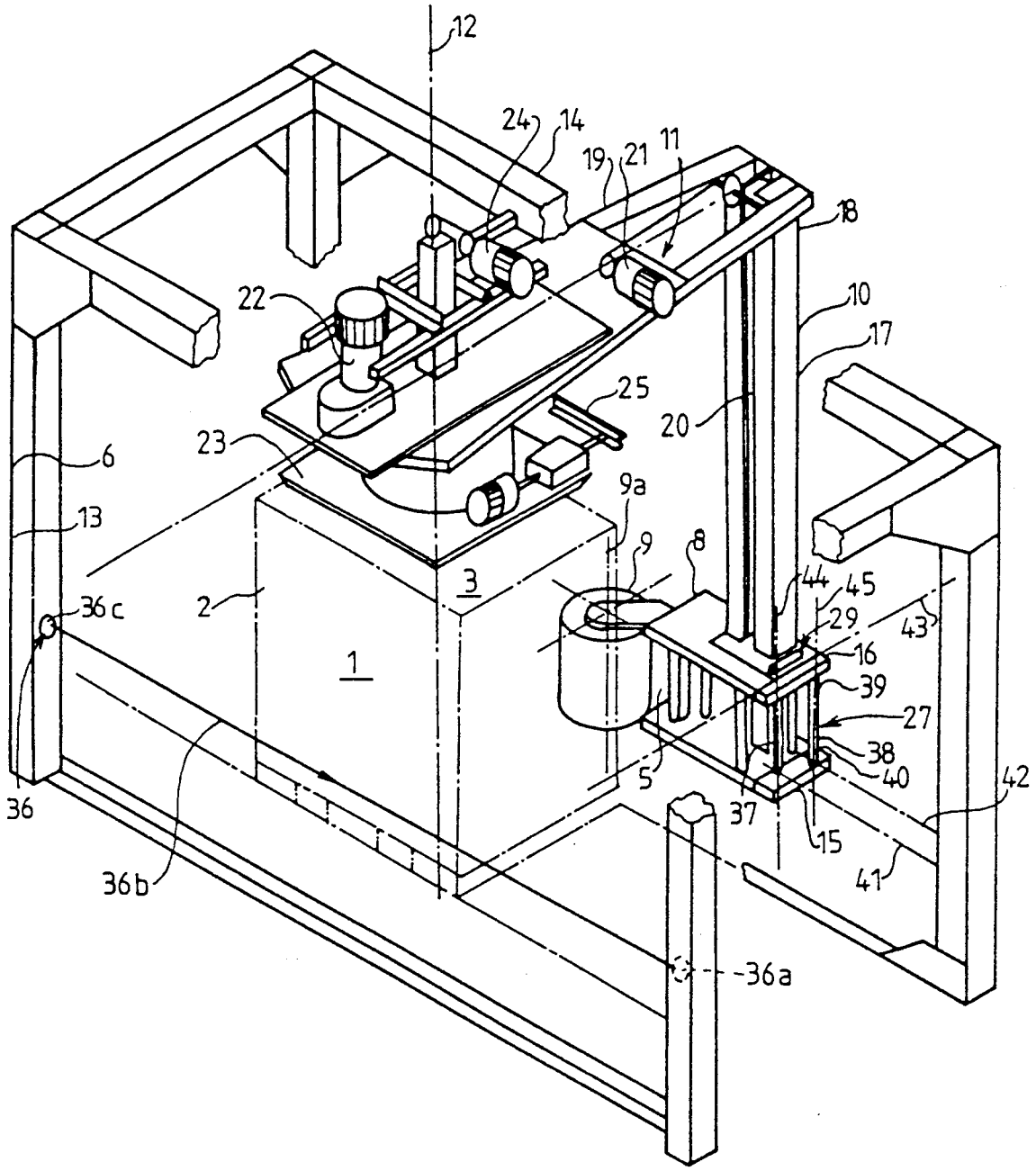
FIG. 1 is a diagrammatic perspective view of a possible alternative of the machine according to the invention.

The machine according to the invention is intended for helically banding the vertical side faces 1 of a palletized load 2, which load is limited moreover by an upper horizontal face 3 and a lower horizontal face 4 (pallet bottom), with a band of plastic film 5 whose width or breadth is a fraction of the height of the load 2 (between the faces 3 and 4). The palletized load 2 comprises on the one hand a lower pallet 2*a* forming a support and template and on the other hand the load 2 itself resting with its lower face on the pallet 2*a*.

The machine according to the invention is of the fixed-table and pivoting-axis reel of film type. To this end, it comprises a stand 6; a table 7 supporting the load 2 in a fixed position during the banding of the load 2 and with which supply means and removal means for the load 2 (such as supply and removal conveyors having rollers coplanar with the table 7) may be combined; a carriage 8 which can move and supports a reel of film 9 having an axis 9*a* with a generally vertical direction; mechanical means 10 for supporting and guiding the carriage 8, which means are carried by the stand 6, such that the carriage 8 may be displaced in a displacement resulting from the combination of an ascending and/or descending vertical displacement and of a displacement in a horizontal loop surrounding the load 2; carriage 8–11 drive means capable of ensuring its effective displacement, in an at least substantially helical path, about the axis 12, surrounding the load 2 with a view to its helical banding with the band of film 5. The stand 6 may have vertical posts (for example four) 13 supporting, at their upper ends, longitudinal members 14 forming a horizontal superstructural frame. This stand 6 surrounds the table 7 placed inside it and in a lower position. The support table 7 is generally of the type enabling the palletized load 2 to be both secured stationary on top of it and also to be supplied and removed. The table 7 has, for example, rollers which are controlled, in terms of their movement and their locking, by way of a geared motor (not shown) or equivalent means. This table 7 is fixed as a unit (as opposed to the so-called pivoting tables of pivoting-table and fixed-axis reel of film banding machines). The table 7, which is horizontal, has an axis which is (or is close to) the axis 12. The carriage 8 forms a compact unit and has, for example, a lower horizontal plate 15 and an upper horizontal plate 16, spaced apart vertically and facing one another, the spacing corresponding substantially to that of the breadth of the film, in other words the axial length of the reel of film 9 placed between the two plates 15, 16.

The means 10 may form the subject of alternative embodiments. In the case of FIG. 1, they are of the rotating-arm type. To this end, they thus have a vertical mast 17, off-centered relative to the axis 12 but parallel to it, supporting the carriage 8 fairly near the bottom and itself supported, at its upper end part 18, on the outer end of a horizontal bracket 19 mounted pivotably about the axis 12 on the stand 6, and in particular its superstructural frame. In this alternative, the carriage 8 is mounted so as to be able to slide vertically up or down on the mast 17 by virtue of the slide means 20 such as a vertical track with which rollers or equivalent means interact In this alternative, the drive means 11 may comprise a means 21 for moving the carriage 8 along the mast 17 and a means 22 for moving the bracket 19 (and hence the mast 17) about the axis 12. These motorization means 21, 22 are controlled from a control box having a programmed robot, such that the bracket 19, and hence the mast 17, may be driven in rotation or locked in rotation and the carriage 8 may be driven slideably on the mast 17 or locked in translation in a coordinated manner appropriate for the package to be formed.

The means 10 may, however, also have other alternative embodiments. The carriage may thus be fixed to a horizontal ring mounted pivotably about the main vertical axis of the machine and carried by a horizontal frame mounted on the stand so as to slide vertically in an ascending or descending motion, a motor carried by the frame enabling the ring to be driven (see document U.S. Pat. No. 4,587,796). Alternatively, the carriage may be mounted slideably on a circular track or an equivalent means surrounding the load, which track forms part of a frame mounted on the stand so as to slide vertically in an ascending or descending motion.

The machine may also comprise a pressure means 23 carried by the stand 6, in particular by the superstructural frame, situated in a horizontal plane with axis 12, and carried so as to be able to pivot about the axis 12 and to be raised or lowered vertically by way of drive means 24 so as to be applied to or freed from the upper horizontal face 3 of the load 2. Such a pressure means 23 intended to be applied to the upper horizontal face 3 of the load helps to hold it in position during the banding operation.

In the case of an automatic machine, it additionally and preferably comprises means for transversely cutting the band of film 5, which means are activated at the end of the banding of the load 2; means for temporarily securing the first end part of the band of film originating from the reel of film 9, which means are active before the beginning of the banding operation; means for combining the last end part of the band of film 5 with the banded load 2, which means are active at the end of the banding operation; and means for controlling and operating the cutting means, the securing means and the combining means.

These cutting, temporarily securing and combining means, together with their control and operating means, may be present independently or be incorporated into a unit with the general form of a pinching tool and/or an applicator mounted moveably in order to be active, inactive or retracted. Reference may here be made to the state of the art (in particular documents (U.S. Pat. No. 4,587,796, EP 0,177,413 or the already mentioned "DRA-PAL OCTOPUS" machine). This set of means may be carried by the carriage 8 or by the pressure means 23 (see document EP 0,180,517) or alternatively directly by the stand. According to one variant of the invention (FIG. 3), these means designated as a whole by the reference numeral 25 and shown merely diagrammatically may be carried by support means 26. The support means 26 are placed essentially beneath the means 25, between the latter and the level of the support table 7, which results in the space above the means 25 being freed. The support means 26 consist, for example, of an elevating platform. This elevating platform 26 is preferably placed in the immediate vicinity of the rotating table 7, between the latter and the path of the mast 17 or of the carriage 8 over the horizontal plane of the rotating table 7. The support means 26 are located laterally, at a distance from the conveyors supplying and removing the load 2. Several alternative embodiments may be envisaged in terms of the vertical sliding travel of the support means 26, and hence the means 25. Either the travel is limited, the means 25 remaining in the vicinity, of the support table 7 but being capable, in this vicinity, of being raised or lowered, up a little to a position above the support table 7, or down a little to a position at least partially beneath it, or the travel is greater and could extend upwards as far as the vicinity of the upper horizontal face 3 of the load 2 (or of the pressure means 23). The choice of the variant is defined as a function of the type of package to be formed: helical with two crossed layers, an inner rising one and an outer descending one in the first case; separated bands forming a single-layer helical strapping or banding in the second case. An elevating platform 26 having the features indicated may form the subject of various alternative embodiments; the table may be supported by a vertical piston placed beneath it, by a rack or alternatively by articulated struts.

The film 5 used may be of the stretchable or non-stretchable type, in particular heat-shrinkable. It may be solid or perforated like a net. It may have a reasonably large breadth. The banding may be continuous, all the turns of film 5 covering each other, or discontinuous, some zones of the load remaining free.

According to the invention, the machine also comprises, in combination, firstly means 27 for deviating in its own plane the band of film 5 originating from the reel of film 9, and for vertically offsetting the downstream delivered section 28 of the band of film 5, with respect to the reel of film 9, which means 27 are on the one hand carried by the carriage 8 at least substantially opposite the reel of film 9 and on the other hand may be deformed during the banding operation between two extreme configurations corresponding to two separate extreme states, an active one in which they ensure the deviating and the maximum vertical offsetting, and an inactive one in which the deviation and offset are zero or minimal, respectively; and secondly means 29 for controlling and driving the deviating and vertical-offsetting means 27 in order to switch them from their active state to their inactive state, or vice versa; such that in a certain relative situation of the carriage 8, during the banding operation, operation of the control and drive means 29 causes the downstream delivered section 28 of the band of film 5 applied to the load 2 to be relatively offset in the vertical direction, with respect to the reel of film 9.

Figure 13:
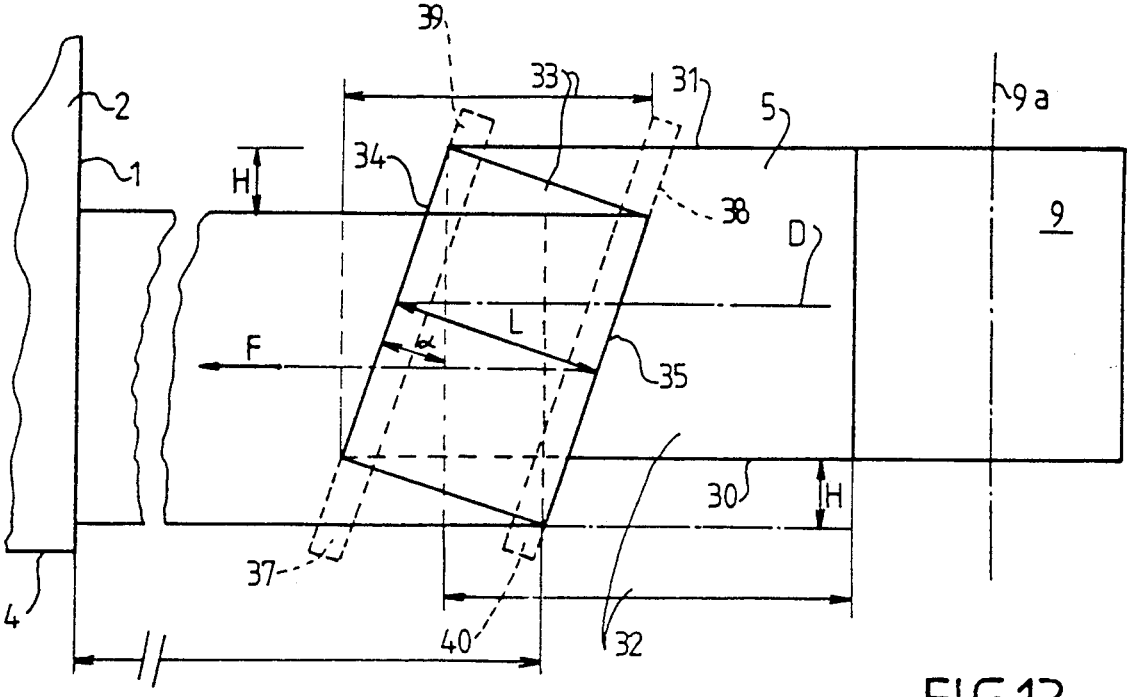
FIG. 13 is a plan view in elevation illustrating the deviation and the offset of the film.
Figure 10:
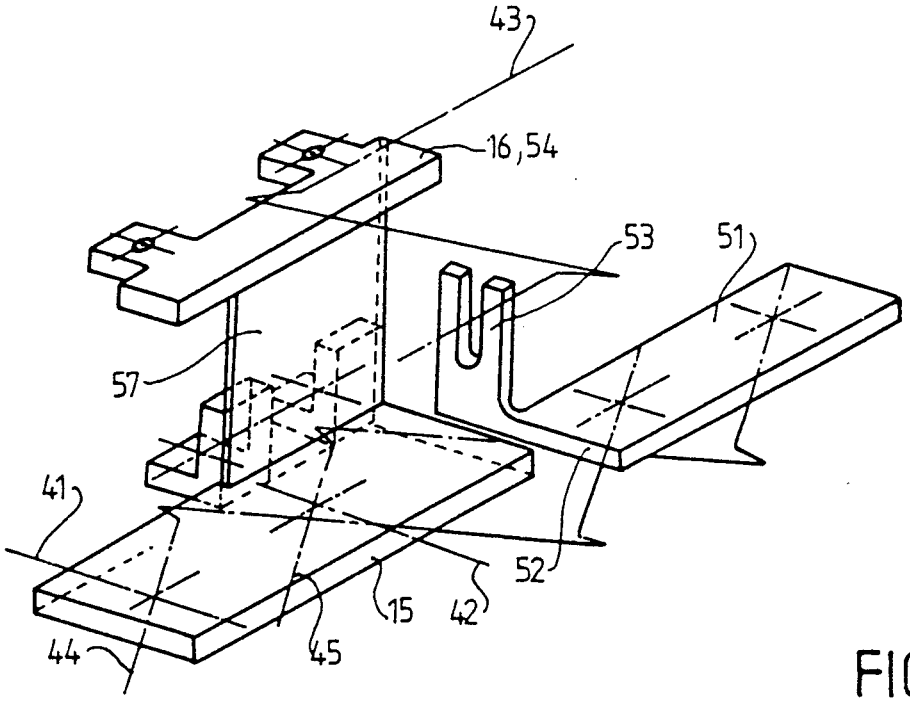
FIG. 10 is an exploded view of the carriage and of the pieces supporting the deviating and guide rods.
Figure 11:
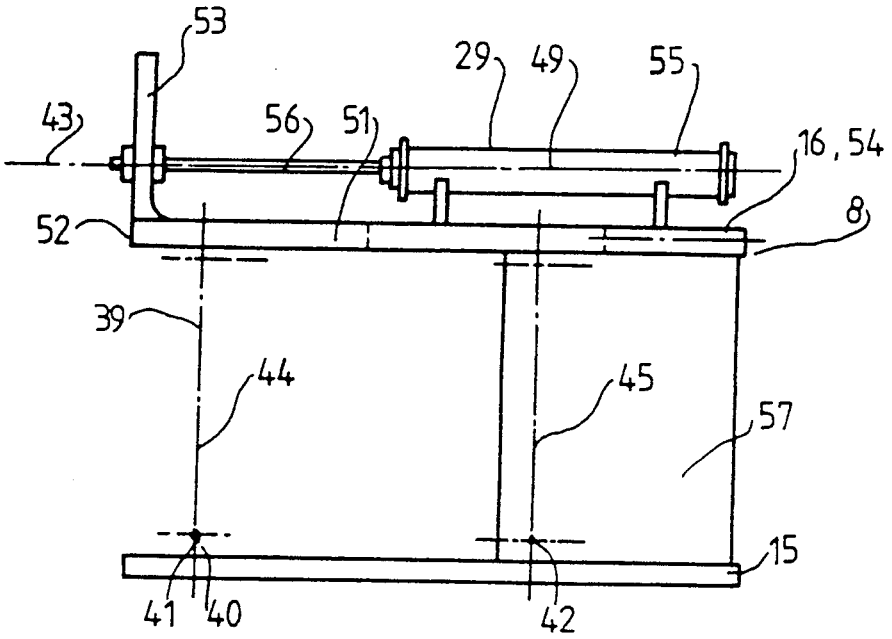
FIGS. 11 and 12 are similar to FIGS. 7 and 9 and illustrate the pivoting and sliding of the deviating and guide rods, as well as the sliding of the drive jack and its sliding relative to the fork-shaped lug of the small plate supporting the deviating and guide rods.

Reference will now be made to FIG. 13 which illustrates the deviation and offset of the film 5 in more detail. In this Figure, the reel of film 9 and the film 5 itself are shown in elevation, the plane of this figure being, in the machine, a vertical plane. D designates the longitudinal center line of the film 5, in other words the straight line situated half-way between the two lower 30 and upper 31 longitudinal free edges of the band of film. It is possible to imagine the film 5 originating from the reel of film 9 to be divided into several sections placed longitudinally one after the other, from upstream to downstream in the direction F in which the film 5 unwinds during the banding, from the reel of film 9 to the load 2, namely: an upstream section 32 delivered from the reel 9 and adjoining the reel 9, an intermediate section 33 on which the deviating and offsetting are carried out, adjoining the upstream section 32 downstream from the latter, and the downstream delivered section 28 downstream from the intermediate section 33 and extending as far as the load 2. The intermediate section 33 has two transverse folds (from one edge 30 to the other 31) of the band of film 5, an upstream fold 34 and a downstream fold 35, respectively. The two folds 34, 35 may be defined as a folding of the band of film 5 back on itself. The two folds 34, 35 are spaced apart from each other along the straight line D by a certain distance L. The two folds 34, 35 are parallel to one another and they are not perpendicular to the straight line D (in other words parallel to the transverse direction T of the band of film, which direction is perpendicular to the straight line D) but inclined to the transverse direction T by an angle a. In the intermediate section 33, the band of film therefore forms, as a result of the folds 34, 35, two or three superposed layers in the form of an accordion. Given the inclination of the folds 34, 35 to the transverse direction T and the parallelism of the two folds 34, 35, the downstream delivered section 28 is offset relative to the upstream section 32 by a value $H = L \sin a$. This means that the straight line D, in the section 28, is offset in parallel and along the axis 9*a* relative to its position in the upstream section 32, this offset being equal to H as has been defined. As a consequence, the longitudinal edges 30, 31 in the section 28 are offset (vertically on the machine) relative to the longitudinal edges, 30, 31 in the section 32. The offset is represented by the dimension H in the figure. The offset may be upwards or downwards (towards the edges 31 or 30, respectively) depending on the direction in which the folds 34, 35 are made. Indeed, the offset is made, relative to the reel 9, on the side opposite where the folds 34, 35 (to be more precise the straight lines which extend them) meet the axis 9*a*. In the case of the figures, the folds 34, 35 intersect the axis 9*a* above the reel 9 such that the film is offset downwards. In particular, the distance between the axis 9*a* and the points of intersection of the folds 34, 35 with the edges 30, 31 of the films is greater for the lower edge 30 than for the upper edge 31. Preferably and according to the invention, as is apparent from what follows, the film 5 is preferably offset downwards, in other words the lower edge 30 is situated lower for the section 28 than for the section 32 or, in other words that end part of the film 5 used for the packaging is situated at a lower level than the reel 9. This is obtained with a band of film 5 which remains held taut and flat without being wrinkled or deformed in its section used for the packaging.

Figure 2:
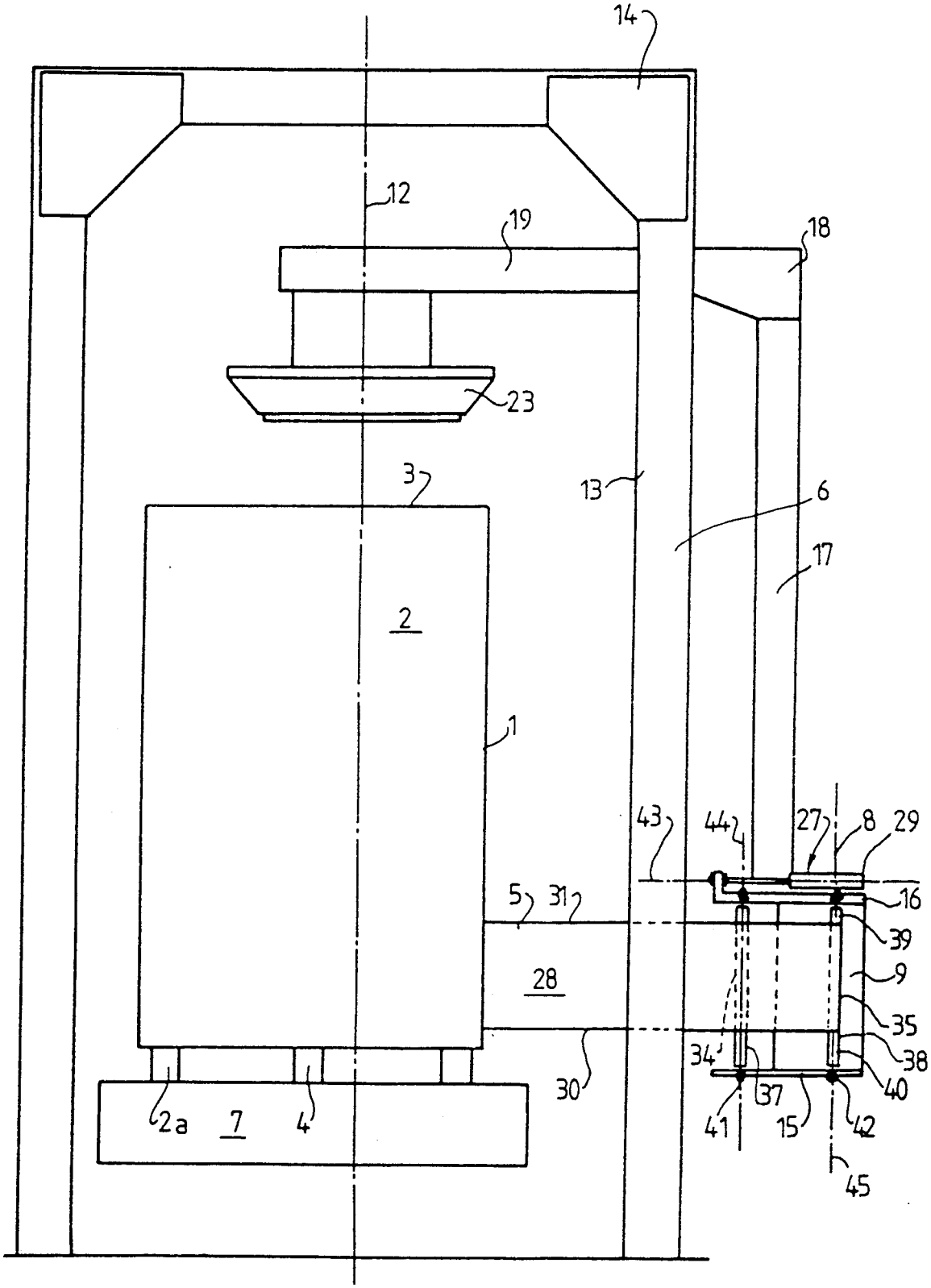
FIGS. 2, 3, 4 are three diagrammatic views in elevation of a possible alternative of the machine according to the invention without offsetting, with offsetting, and with offsetting and folding or curling, respectively.

As is clear from the description, the means 27, by way of the means 29, enable the film 5 either to be deviated or offset (FIG. 3) or not to be deviated or offset (FIG. 2).

In a first alternative embodiment, the means 29 for controlling and driving the deviating and vertical-offsetting means 27 are manual and comprise a manual control element which may be actuated by an operator. In a second alternative embodiment (as in the figures) the means 29 for controlling and driving the deviating and vertical-offsetting means 27 are automatic and controlled by the position of the carriage 8, in particular by the relative position of the carriage 8 with respect to the table 7 in the vertical direction, or alternatively the height of the carriage 8 or of the reel of film 9 with respect to the table 7 supporting the load 2. In this second variant, the machine preferably comprises means 36 for identifying the relative position of the carriage 8 with respect to the table 7 in the vertical direction; and a programmed robot which, as a function of this relative position, defines, for the means 29 for controlling and driving the deviating and vertical-offsetting means 27, the state in which the latter should be. The means 36 have, for example, a photoelectric cell **36*a* receiving a beam of light 36*b* emitted by a light source 36*c*, where the cell 36*a* and the source 36*c* may be carried by the stand 6, in particular by the posts 13, and the beam 36*b* may be intercepted by the carriage 8 or the film 5. These identification means 36 enable a position to be defined triggering the control of the deviating and vertical-offsetting means 27 which is a certain relative position of the carriage 8 with respect to the table 7 in the vertical direction, on either side of which the deviating and vertical-offsetting means 27 are in one of their two active and inactive extreme states, respectively. If necessary, several sets of means 36** situated at different heights of the machine, and hence several triggering positions, may be provided.

Preferably and depending on the application envisaged for the machine according to the invention, the triggering position is or is close to the relative position of the carriage 8 closest to the table 7 in the vertical direction—in other words the lowermost relative position of the carriage 8—the deviating and vertical-offsetting means 27 being in the inactive state and active state, respectively, when the carriage 8 is further away from, in other words above, and less far away from, in other words beneath, the triggering position, with respect to the table 7 and the vertical direction, such that in the same lowermost relative position of the carriage 8 the band of film 5 originating from the reel of film 9 is applied to vertically separate zones of the side faces 1 of the load 2, namely on the one hand facing the reel of film 9 and on the other hand offset downwards with respect to the reel of film 9, with the result that the band of film 5 may cover the load 2, with a view to banding it, as far as its lower face 4, or close to the latter, without the reel of film 9 or the moving components of the machine which are associated with it interfering with the other components or parts of the machine (in particular the conveyors).

In the method according to the invention, a load 2 to be banded is supplied and placed on a table 7 supporting it in a fixed position; the first end part of a band of film 5 originating from a reel of film 9 having an axis **9*a* with a generally vertical direction is secured against a vertical face 1 of the load 2; with the load 2 remaining stationary, the reel of film 9 is displaced about the load 2 and the reel of film 9 is consequently unwound and the load 2 banded with the band of film 5 originating from the reel 9; in this way, at least one turn of the band of film 5 is formed on the load 2; the band of film 5 is cut transversely; the last end part of the band of film 5 is combined with the banded load 2; the new first end part of the band of film 5 is secured and the banded load 2 is removed. In at least one stage of the banding of the load 2 with the band of film 5, the reel of film 9 is displaced in a path in a horizontal loop and in this stage the band of film 5 unwound from the reel 9 is deviated and offset in the vertical direction. The deviating and offsetting stage is preferably performed when the reel of film 9 has been brought into its relative position closest to the table 7 in the vertical direction. Also, and in particular, the deviating and offsetting stage is performed at the end of a helical banding procedure. This means that the machine according to the invention may function in a general manner in the cycles known from the prior art. However, when the carriage 8 is placed at its lowermost level on the mast 17, in other words slightly above the level of the table 7, and of the supply and removal conveyors, in order not to interfere with them during the pivoting of the carriage 8 about the axis 12 (FIG. 2), the deviating and offsetting means 27 switch from their inactive state to their active state (FIG. 3)l which enables lower zones of the palletized load 2 to be covered, for example the pallet 2*a* itself, without lowering further the carriage 8. In the variant where they consist of an elevating platform placed next to the table 7, the support means 26 may be combined in functional terms with the offsetting of the film obtained by the means 27**.

Figure 3:
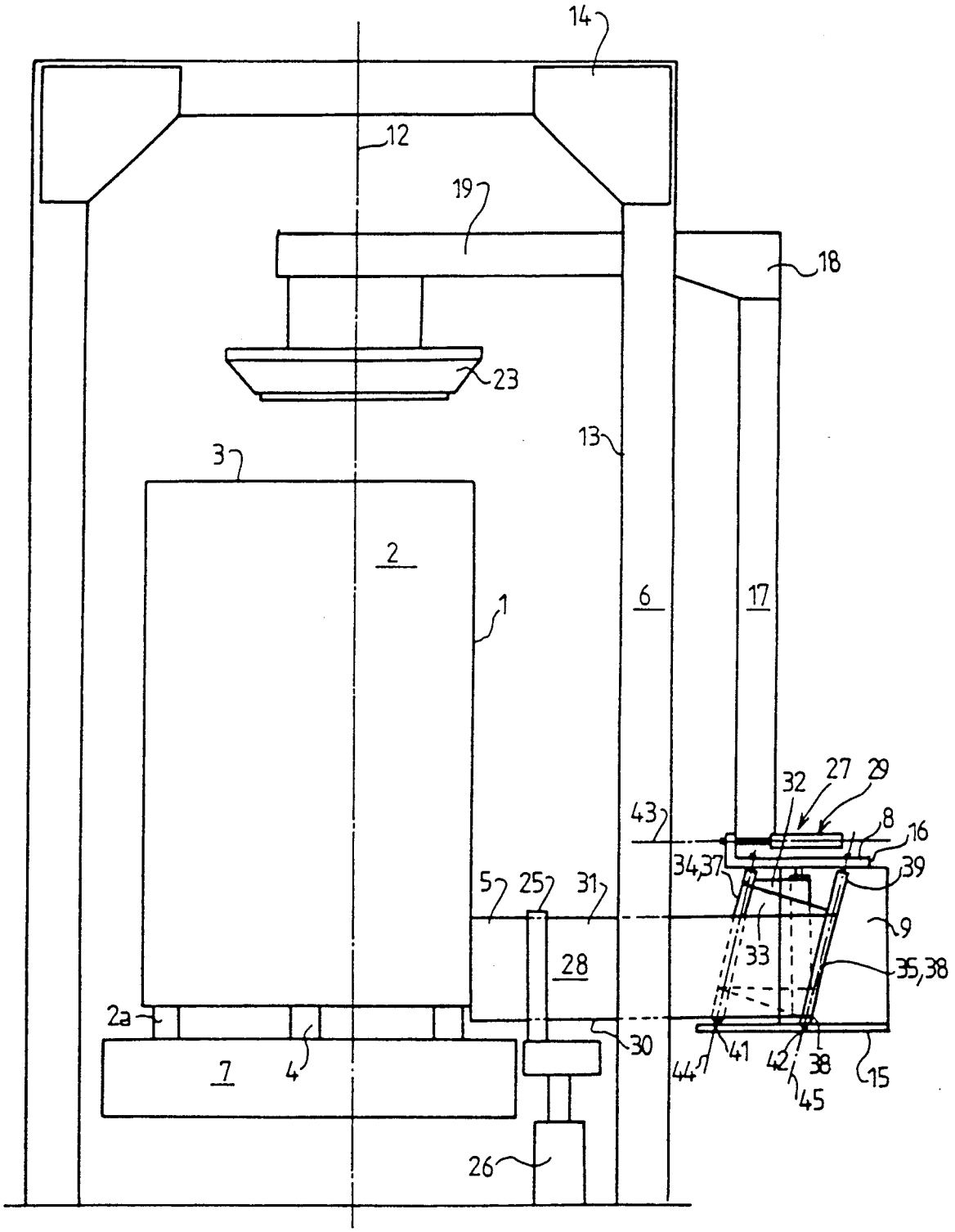

In a preferred embodiment, the deviating and vertical-offsetting means 27 comprise at least two rods 37, 38 for returning and guiding the band of film 5 which are parallel to one another, spaced apart from one another transversely and at least substantially opposite one another, namely an upstream rod 37 and a downstream rod 38, over which rods in this order passes the band of film 5 originating from the reel of film 9 such that they can guide the deviated and offset band of film, forming two folds, an upstream one 34 and a downstream one 35, respectively. These two rods 37, 38 are carried by the carriage 8. They may move as a whole and may be locked between two separate extreme positions, inclined to the vertical and vertical, respectively, corresponding to the two active and inactive extreme states. In FIG. 2, the rods 37 and 38 are vertical and parallel with the axis **9*a*, which corresponds to the inactive state of the means 27. In FIG. 3, on the other hand, the rods 37 and 38 are inclined to the vertical with their respective upper ends 39 further away from the axis 12 than their respective lower ends 40, this situation corresponding to the active state of the means 27 offsetting the film 5** downwards.

Figure 4:
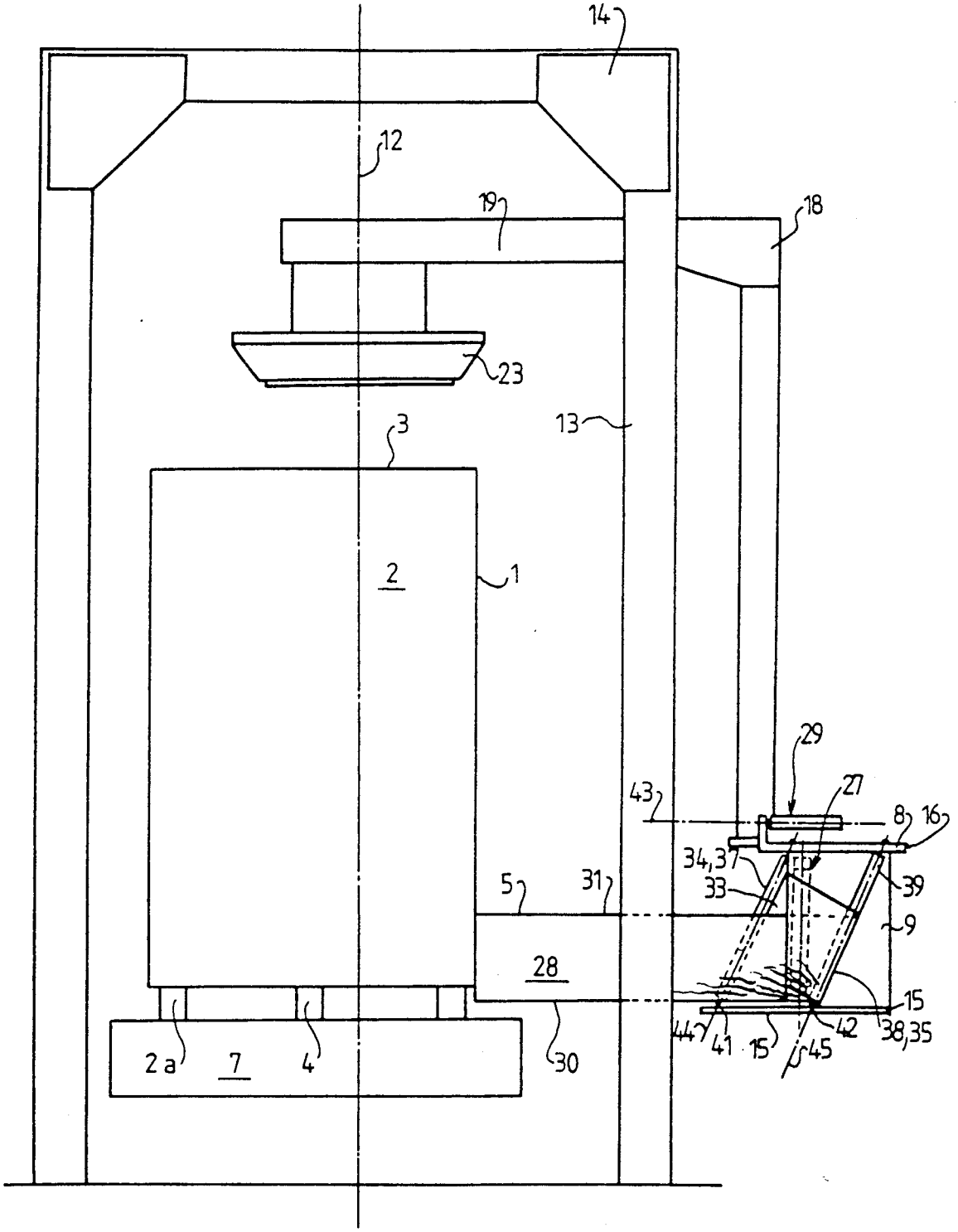
Figure 6:
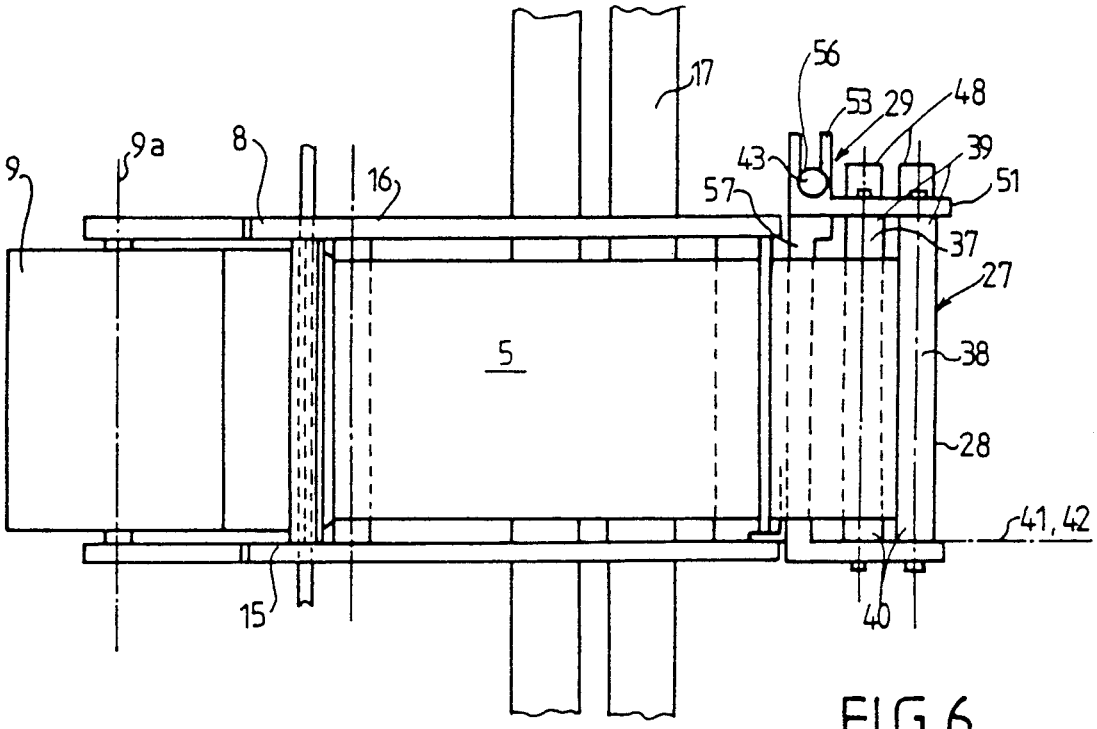
FIGS. 5 and 6 are two diagrammatic views in elevation from above and from the front, respectively, of the carriage and of the film-deviation means for the machine according to the invention.
Figure 5:
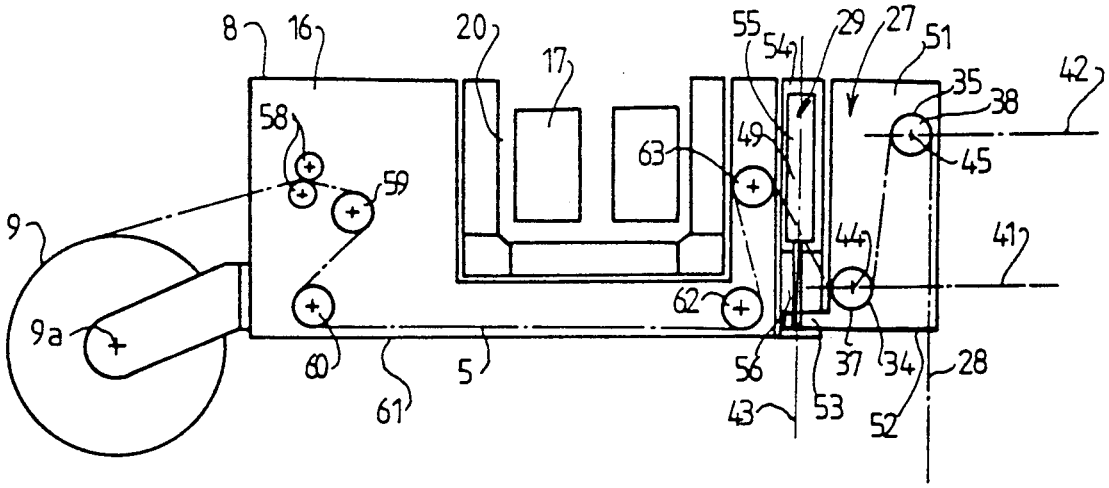
Figure 7:
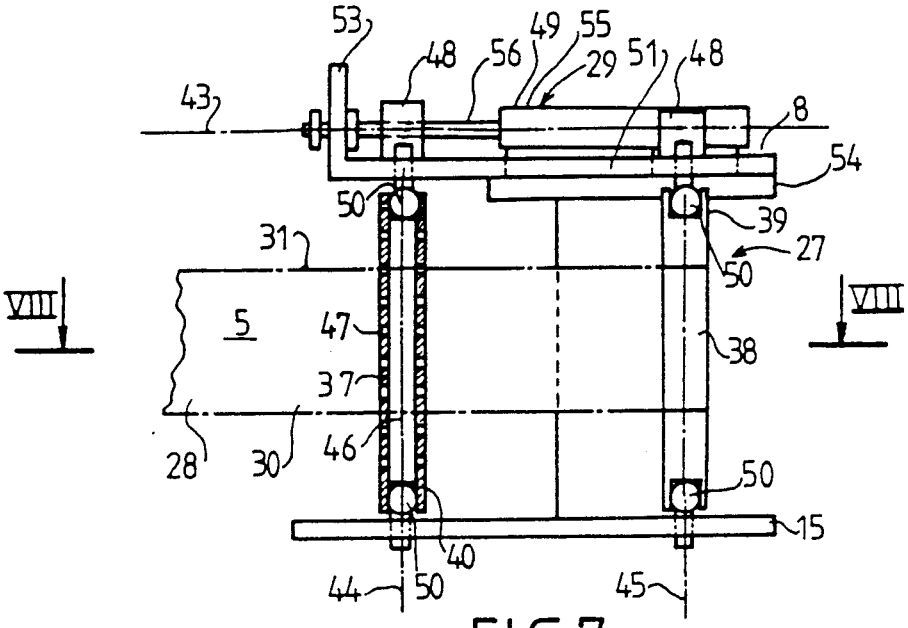
FIGS. 7 and 9 are two side views of the carriage illustrating in more detail the deviating means and the means for controlling and driving the latter.
Figure 8:
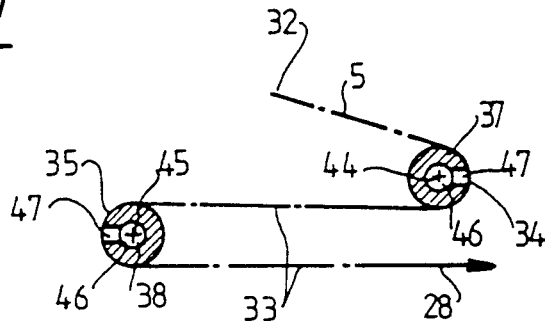
FIG. 8 is a view in cross-section along the line VIII—VIII in FIG. 7.
Figure 9:
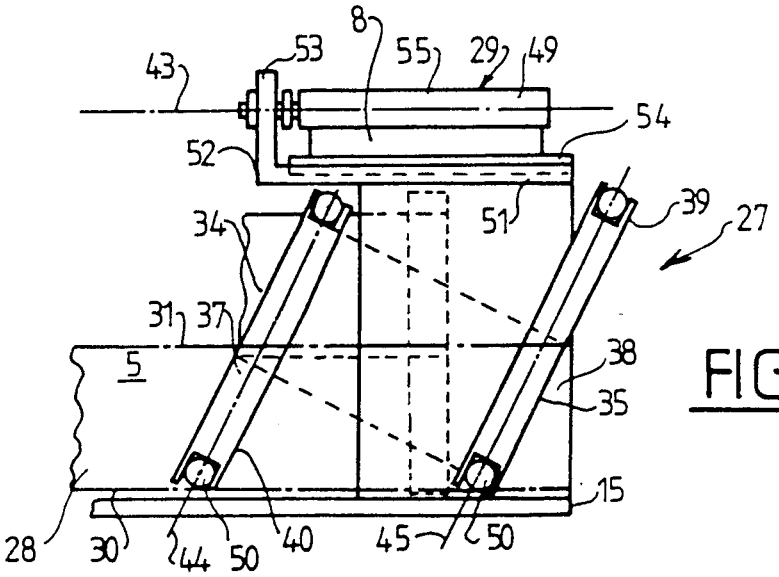
Figure 12:
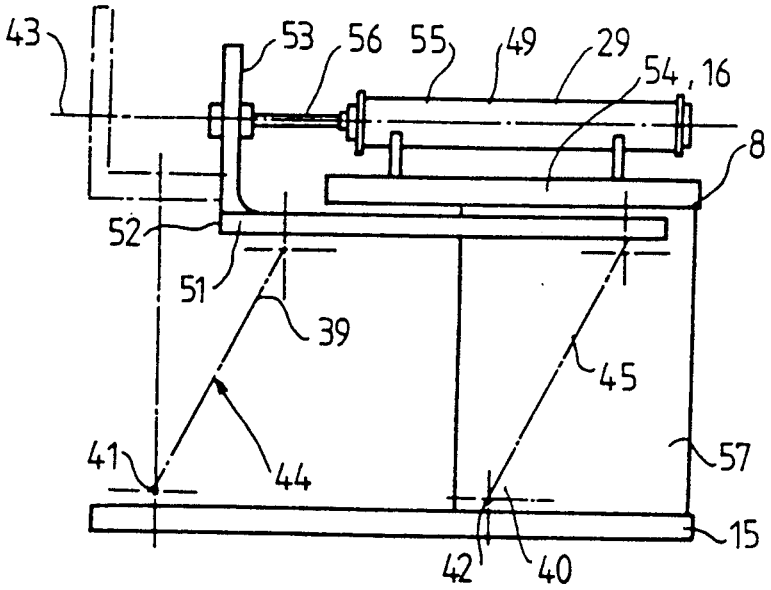

In order to ensure the mobility of the rods 37, 38 with a view to switching them from the vertical situation to the inclined situation (or vice versa) by operating the deviating and offsetting means 27, the return and guide rods 37, 38 are carried by the carriage 8, being able to move by pivoting as a whole and to be locked about axes 41, 42 which are horizontal, parallel to one another and substantially perpendicular to the axes of the return and guide rods 37, 38 and to the vertical plane passing through the axes 9a of the reel of film 9 and the axis 2 of the load 2, or alternatively the plane of the downstream delivered section 28. The unit formed by the two return and guide rods 37, 38 is, for example, mounted articulated at a first one of their ends 40 or 39 on the carriage 8 about axes of pivoting 41, 42 and is mounted so as to slide at a second one of their ends 39 or 40 on the carriage 8 along an axis of sliding 43 which is horizontal and orthogonal to their axes of pivoting 41, 42. In the variant illustrated in the drawings, the first end is the lower end 40 and the second end is the upper end 39. As can be clearly seen in FIGS. 4, 12, 13, the return and guide rods 37, 38 constitute, together with the carriage 8, a deformable parallelogram which ensures the deviation and offsetting of the film 5. The axis of sliding 43 is preferably situated substantially in the plane passing through the axis 12 and the two longitudinal axis, 44, 45 of the two rods 37, 38.

The two return and guide rods 37, 38 are stationary, as a unit, relative to their respective longitudinal axis, 44, 45 and having an outer surface capable of permitting the sliding of the band of film, with no or only limited friction. The return and guide rods 37, 38 are, for example, longitudinally hollow, each having an axial channel 46, and are provided with holes 47 opening out onto their outer surfaces connected to the axial channel 46 or opening onto that part of their outer surface receiving the film. A source of compressed air is connected to the channels 46 by linking ducts 48. A control for the source of compressed air ensures that compressed air is discharged through the open holes 47 during the banding operation, in particular during the deviation and offsetting stage. This result may be reinforced by making the rods 37, 38 from polished slippery metal and with a small diameter in order to limit contact with the film 5. The means 29 for controlling and driving the deviating and vertical-offsetting means 27 comprise means for driving, and locking, the return and guide rods 37, 38 between their drive means comprise at least one jack 49 carried by the carriage 8 and arranged at least substantially horizontally in the axis of sliding 43 and orthogonally to the axes of pivoting 41, 42 of the return and guide rods 37, 38, driving the return and guide rods 37, 38 between their two separate end positions.

The return and guide rods 37, 38 are mounted at their ends, 39, 40 on ball-and-socket joints 50. These are carried, at the lower ends 40, by the lower plate 15 and at the upper ends by a small plate 51 substantially coplanar with the upper plate 16 and placed next to it, opposite the zone of the lower plate in which the ball-and-socket joints 50 are situated. The small plate 51 carries, on its front edge 52, a fork-shaped lug 53 which is offset in order to face the upper plate 16 or a fixing lug 54 on the carriage 8 (in particular the upper plate 16). The jack 49 is fixed by its body 55 to the upper plate 16 or the lug 54 and its rod 56 is fixed at its end to the fork-shaped lug 53 so as to be able to slide transversely, perpendicular to the axis of sliding 43. A post 57 preferably rigidly joins the lug 54 to the lower plate 51, this post 57 being situated in a vertical plane. The rod 56 of the jack 49 is combined with the fork-shaped lug 53 in such a way that the sliding of the rod results in the concomitant sliding of the small plate 51, whilst at the same time permitting a relative vertical movement of the fork-shaped lug 53 with respect to the jack rod 56, which is required because the small plate 51 and the lower plate 15 form, together with the rods 37,38, a deformable parallelogram and are therefore capable of being moved closer to one another, or away from one another, depending on the state of deformation (flattening) of the parallelogram.

As has already been mentioned, in their active position the return and guide rods 37, 38 are inclined with their upper ends 39 furthest away from the axis 12 of the table 7 supporting the load 2 and their lower ends 40 closest to the axis 12. As is apparent from the above, the film 5 slides over the rods 37, 38 both in the direction of its unwinding and also transversely in order to offset it. To this end, it is provided for the rods 37, 38 to have a length substantially greater than the width or breadth of the film 5 in order to permit this transverse sliding without obstructing it.

The return and guide rods 37, 38 are situated near the reel of film 9 and at a distance in the horizontal direction from the vertical side faces 1 of the load 2. The unit formed by the carriage 8 supporting the reel of film 9 and the means 27 and 29 is therefore compact. The carriage 8 may also have a series of rollers for guiding the film 5, namely two rollers 58 against one another (on either side of the film) near the reel of film 9; two successive rollers separated from one another in the direction of the unwinding of the band of film 5, namely an upstream roller 59 and a downstream roller 60 which are both close to the reel of film 9 and the rollers 58, the roller 60 bringing the film 5 towards that edge 61 of the carriage 8 turned towards the table 7 in order to keep away from and not interfere with the mast 17. Two other rollers 62, 63 are placed opposite the reel 9, near the means 27, 29 and substantially symmetrically with the rollers 59, 60 relative to a vertical plane of symmetry of the mast 17. Other structures may, however, be envisaged for the carriage 8.

According to another feature of the invention, the machine also comprises an element for longitudinally pleating or curling an edge 30 or 31 of the band of film 5, which element is carried by the carriage 8 downstream from the deviating and vertical-offsetting means 27. Furthermore, this pleating or curling element preferably consists of the lower plate 15 which supports the return and guide bars 37, 38 at their lower ends 40 and against which the band of film is stressed as a result of its deviation by said rods 37, 38, given that said rods 37, 38 have an appropriate and adapted axial length, as is clearly visible in FIG. 4. It will be understood that the pleating element 15 formed in this way is combined in functional terms with the deviating and offsetting means 27. The length of the rods 37, 38 need only be adapted to the angle of inclination of the rods 37, 38, to the vertical, in order to obtain a pleating or curling of the lower edge 30 of the band of film 5. This pleating or curling means that the downstream delivered section 28 then has a smaller transverse width than the film 5, in band form, situated on the reel 9.

The downward offsetting of the film 5 by way of the means 27, 29, combined with the pleating or curling of the lower horizontal edge 30 of the film, enables a package to be obtained which is of a higher quality than those obtained previously.

In the case of this alternative embodiment with pleating or curling, the method is such that the band of film 5 to be applied to the load 2 is pleated longitudinally in at least one part of the deviating and offsetting stage.

When using a stretchable film, the machine according to the invention may have means for longitudinally stretching the film 5 which are carried by the carriage 8. These longitudinal-stretching means consist, for example, of a pre-stretching device having at least one pivoting roller over which passes the film 5 in a synchronized manner from an upstream zone at a lower upstream speed to a downstream zone at a higher downstream speed. There is no need to describe such pre-stretching devices here as the person skilled in the art may refer to the prior art. For example, a differential-speed two-roller pre-stretching device of this type could be formed by the pair of rollers 59, 60 or 62, 63 arranged accordingly. In a variant, the pre-stretching device is placed downstream from the deviating and offsetting means 27.

It is self-evident that the subject of the invention is also the variant in which the offsetting takes place in several stages by way of a plurality of units such as those described singly.

I claim:

1. A machine for helically banding the vertical side faces of a palletized load with a band of plastic film whose width is a fraction of the height of the load, which comprises:

a stand;

a table supporting the load in a fixed position during the banding of the load and with which supply means and removal means for the load are combined;

a moveable carriage supporting a reel of film having an axis with a generally vertical direction;

mechanical means for supporting and guiding the carriage, which means are carried by the stand, such that the carriage is displaced in a displacement resulting from the combination of an ascending and/or descending vertical displacement, and of a displacement in a horizontal loop surrounding the load;

carriage drive means capable of ensuring its effective displacement in an at least substantially helical path, about a vertical axis, surrounding the load with a view to helically banding it with the band of film;

wherein it comprises, in addition and in combination:

means for deviating in its own plane the band of film originating from the reel of film and for vertically offsetting the downstream delivered section of the band of film with respect to the reel of film, which means are on the one hand carried by the carriage at least substantially opposite the reel of film and on the other hand may be deformed during the banding operation between two extreme configurations corresponding to two separate extreme states, an active one in which they ensure the deviation and the maximum vertical offsetting and an inactive one in which the deviation and offset are zero or minimal, respectively;

means for controlling and driving the deviating and vertical-offsetting means in order to switch them from their active state to their inactive state, or vice versa;

such that in a certain relative situation of the carriage during the banding operation, operation of the control and drive means results in the downstream delivered section of the band of film applied to the load being offset relatively in the vertical direction with respect to the reel of film.

2. The machine as claimed in claim 1, wherein it furthermore comprises, carried by support means, a set of means comprising:

means for transversely cutting the band of film, which means are activated at the end of the banding of the load;

means for temporarily securing the first end part of the band of film originating from the reel of film, which means are active before the beginning of the banding operation;

means for combining the last end part of the band of film with the banded load, which means are active at the end of the banding operation;

and means for controlling and operating the cutting means, the securing means and the combining means.

3. The machine as claimed in claim 1, wherein the means for controlling and driving the deviating and vertical-offsetting means are manual and have a manual-control element which may be actuated by an operator.

4. A machine for helically banding the vertical side faces of a palletized load with a band of plastic film whose width is a fraction of the height of the load, which comprises:

a stand;

a table supporting the load in a fixed position during the banding of the load and with which supply means for the load may be combined;

a moveable carriage supporting a reel of film having an axis with a generally vertical direction;

mechanical means for supporting and guiding the carriage, which means are carried by the stand, such that the carriage may be displaced in a displacement resulting from the combination of an ascending and/or descending vertical displacement, and of a displacement in a horizontal loop surrounding the load;

carriage drive means capable of ensuring its effective displacement in an at least substantially helical path, about a vertical axis, surrounding the load with a view to helically banding it with the band of film;

wherein it comprises, in addition and in combination;

means for deviating in its own plane the band of film originating from the reel of film and for vertically offsetting the downstream delivered section of the band of film with respect to the reel of film, which means are on the one hand carried by the carriage at least substantially opposite the reel of film and on the other hand may be deformed during the banding operation between two extreme configurations corresponding to two separate extreme states, an active one in which they ensure the deviation and the maximum vertical offsetting and an inactive one in which the deviation and offset are zero or minimal, respectively;

means for controlling and driving the deviating and vertical-offsetting means in order to switch them from their active state to their inactive state, or vice versa, which are automatic and controlled by the position of the carriage, in particular by the relative position of the carriage with respect to the table in the vertical direction;

such that in a certain relative situation of the carriage during the banding operation, operation of the control and drive means results in the downstream delivered section of the band of film applied to the load being offset relatively in the vertical direction with respect to the reel of film.

5. The machine as claimed in claim 4, wherein it comprises means for identifying the relative position of the carriage with respect to the table in the vertical direction; and a programmed robot which, as a function of this relative position, defines, for the means for controlling and driving the deviating and vertical-offsetting means, the state in which the latter should be.

6. The machine as claimed in claim 4, wherein at least one position is provided triggering the control of the deviating and vertical-offsetting means which is a certain relative position of the carriage with respect to the table in the vertical direction, on either side of which the deviating and vertical-offsetting means are in one of their two active and inactive extreme states, respectively.

7. The machine as claimed in claim 6, wherein the triggering position is or is close to the relative position of the carriage closest to the table in the vertical direction, in other words the lowermost relative position of the carriage, the deviating and vertical-offsetting means being in the inactive state and in the active state, respectively, when the carriage is further away from, in other words, above, and less far away from, in other words beneath, the triggering position, with respect to the table and the vertical direction, such that in the same lowermost relative position of the carriage the band of film originating from the reel of film is applied to vertically separate zones of the side faces of the load, namely on the one hand opposite the reel of film and on the other hand offset downwards with respect to the reel of film, which results in the band of film being able to cover the load, with a view to banding it, as far as its lower face without the reel of film or the moving components of the machine which are associate with it interfering with the other components or parts of the machine.

8. A machine for helically banding the vertical side faces of a palletized load with a band of plastic film whose width is a fraction of the height of the load, which comprises:

a stand;

a table supporting the load in a fixed position during the banding of the load and with which supply means and removal means for the load may be combined;

a moveable carriage supporting a reel of film an axis with a generally vertical direction;

mechanical means for supporting and guiding the carriage, which means are carried by the stand, such that the carriage may be displaced in a displacement resulting from the combination of an ascending and/or descending vertical displacement and of a displacement in a horizontal loop surrounding the load;

carriage drive means capable of ensuring its effective displacement in an at least substantially helical path, about a vertical axis, surrounding the load with a view to helically banding it with the band of film;

wherein it comprises, in addition and in combination:

means for deviating in its own plane the band of film originating from the reel of film and for vertically offsetting the downstream delivered section of the band of film with respect to the reel of film, which means are on the one hand carried by the carriage at least substantially opposite the reel of film and on the other hand may be deformed during the banding operation between two extreme configuration corresponding to two separate extreme stages, an active one in which they ensure the deviation and the maximum vertical offsetting and an inactive one in which the deviation and offset are zero or minimal, respectively, the deviating and vertical-offsetting means comprising at least two rods for returning and guiding the band of film which are parallel to one another, spaced transversely apart from one another and at least substantially face one another, namely an upstream rod and a downstream rod over which passes in this order the band of film originating from the reel of film so that they are able to guide the deviated and offset band of film, forming two folds, an upstream one and a downstream one, respectively; these two rods being carried by the carriage and being able to move as a unit and to be locked between two separate extreme positions, inclined to the vertical and vertical, respectively, corresponding to the two extreme active and inactive states;

means for controlling and driving the deviating and vertical-offsetting means in order to switch them from their active state to their inactive stage, or vice versa;

such that in a certain relative situation of the carriage during the banding operation, operation of the control and drive means results in the downstream delivered section of the band of film applied to the load being offset relatively in the vertical direction with respect to the reel of film.

9. The machine as claimed in claim 8, wherein the return and guide rods are carried by the carriage and are able to move pivotably as a unit and to be locked about the horizontal axes which are parallel to one another and substantially perpendicular to the axes of the return and guide rods and to the vertical plane passing through the axis of the reel of film and the axis of the load.

10. The machine as claimed in claim 9, wherein the unit formed by the two return and guide rods is mounted articulated at a first one of their ends on the carriage about axes of pivoting.

11. The machine as claimed in claim 9, wherein the unit formed by the two return and guide rods is mounted so as to slide at a second one of their ends on the carriage along a horizontal axis of sliding orthogonal to their axes of pivoting.

12. The machine as claimed in claim 8, wherein the two return and guide rods are as a unit stationary relative to their respective longitudinal axis and have an outer surface capable of enabling the band of film to slide with no or only limited friction.

13. The machine as claimed in claim 8, wherein the two return and guide rods are longitudinally hollow, each having an axial channel, and are provided with holes opening onto their outer surfaces connected to the axial channel; a source of compressed air being connected by linking ducts to the channels; a control for the source of compressed air ensuring the discharge of compressed air through the open holes during the banding operation, in particular during the deviating and offsetting stage.

14. The machine as claimed in claim 8, wherein the means for controlling and driving the deviating and vertical-offsetting means comprise means for driving and locking the return and guide rods between their two extreme positions.

15. The machine as claimed in claim 14, wherein the drive means comprise at least one jack carried by the carriage and arranged at least substantially horizontally in the axis of sliding and orthogonally to the axis of pivoting of the return and guide rods, driving the two return and guide rods between then separate extreme positions.

16. The machine as claimed in claim 8, wherein in their active position the return and guide rods are inclined with their upper ends furthest away from the axis of the table supporting the load and their lower ends closest to the axis.

17. The machine as claimed in claim 8, wherein the return and guide rods are situated near the reel of film and at a distance, in the horizontal direction, from the vertical side faces of the load.

18. A machine for helically banding the vertical side faces of a palletized load with a band of plastic film whose width is a fraction of the height of the load, which comprises:

a stand;

a table supporting the load in a fixed position during the banding of the load and with which supply means and removal means for the load may be combined;

a moveable carriage supporting a reel of film having an axis with a generally vertical direction;

mechanical means for supporting and guiding the carriage, which means for carried by the stand, such that the carriage may be displaced in a displacement resulting from the combination of an ascending and/or descending vertical displacement, and of a displacement in a horizontal loop surrounding the load;

carriage drive means capable of ensuring its effective displacement in an at least substantially helical path, about a vertical axis, surrounding the load with a view to helically banding it with the band of film;

wherein it comprises, in addition and in combination:

means for deviating in its own plane the band of film originating from the reel of film and for vertically offsetting the downstream delivered section of the band of film with respect to the reel of film, which means are on the one hand carried by the carriage at least substantially opposite the reel of film and on the other hand may be deformed during the banding operation between two extreme configurations corresponding to two separate extreme states, an active one in which they ensure the deviation and the maximum vertical offsetting and an inactive one in which the deviation and offset are zero or minimal, respectively;

means for controlling and driving the deviating and vertical-offsetting means in order to switch them from their active state to their inactive state, or vice versa;

an element for longitudinally pleating or curling an edge of the band of film, which element is carried by the carriage downstream from the deviating and vertical-offsetting means.

19. The machine as claimed in claim 18, wherein the element for longitudinally pleating or curling the lower edge of the band of film consists of the lower plate which supports the return and guide rods at their lower ends and against which is stressed the band of film as a result of its deviation by said rods, given the axial length of said rods.

20. The machine as claimed in claim 1, wherein it is intended to employ a stretchable film and has means for longitudinally stretching the film which are carried by the carriage.

21. The machine as claimed in claim 20, wherein the longitudinal-stretching mean consist of a pre-stretching device having at least one pivoting roller over which passes the film in a synchronized manner from an upstream zone at a lower upstream speed to a downstream zone at a higher downstream speed.

22. A machine for helically banding the vertical side faces (1) of a palletized load (2) with a band of plastic film (5) whose width is a fraction of the height of the load (2), which comprises;

a stand (6);

a table (7) supporting the load (2) in a fixed position during the banding of the load (2) and with which supply means and removal means for the load (2) are combined;

a moveable carriage (8) supporting a reel of film (9) having an axis (9a) with a generally vertical direction;

mechanical means (10) for supporting and guiding the carriage (8), which means are carried by the stand (6), such that the carriage (8) may be displaced in a displacement resulting from the combination of an ascending and/or descending vertical displacement, and of a displacement in a horizontal loop surrounding the load (2);

carriage (8)-drive means (11) capable of ensuring its effective displacement in an at least substantially helical path, about a vertical axis (12), surrounding the load (2) with a view to helically banding it with the band of film (5);

and, in addition, carried by support means (26), a set of means (25) comprising:

means for transversely cutting the band of film (5), which means are activated at the end of the banding of the load (2);

means for temporarily securing the first end part of the band of film (5) originating from the reel of film (9), which means are active before the beginning of the banding operation;

means for combining the last end part of the band of film (5) with the banded load (2), which means are active at the end of the banding operation;

and means for controlling and operating the cutting means, the securing means and the combining means;

which support means (26) are arranged in order to enable means (25) to slide in the vertical direction, wherein it comprises, in addition and in combination:

firstly means (27) for deviating in its own plane the band of film (5) originating from the reel of film, (9) and for vertically offsetting the downstream delivered section (28) of the band of film (5) with respect to the reel of film (9), which means (27) are on the one hand carried by the carriage (8) at least substantially opposite the reel of film (9) and on the other hand may be deformed during the banding operation between two extreme configurations corresponding to two separate extreme states, an active one in which they ensure the deviation and the maximum vertical offsetting and an inactive one in which the deviation and offset are zero or minimal, respectively;

and secondly means (29) for controlling and driving the deviating and vertical-offsetting means (27) in order to switch them from their active state to their inactive state, or vice versa;

such that in a certain relative situation of the carriage (8) during the banding operation, operation of the control and drive means (29) results in the downstream delivered section (28) of the band of film (5) applied to the load (2) being offset relatively in the vertical direction with respect to the reel of film (9);

and wherein the support means (26) are essentially placed beneath the means (25), between the latter and the level of the support table (7), which results in the space above the means (25) being freed.

* * * * *

UNITED STATES PATENT AND TRADEMARK OFFICE

CERTIFICATE OF CORRECTION

PATENT NO. : 5,040,359

DATED : August 20, 1991

INVENTOR(S) : Jacques Thimon

It is certified that error appears in the above-identified patent and that said Letters Patent is hereby corrected as shown below:

claim 22 removing the reference numerals as follows:

A machine for helically banding the vertical side faces [(1)] of a palletized load [(2)] with a band of plastic film [(5)] whose width is a fraction of the height of the load [(2)], which comprises;

a stand [(6)];

a table [(7)] supporting the load [(2)] in a fixed position during the banding of the load [(2)] and with which supply means and removal means for the load [(2)] are combined;

a moveable carriage [(8)] supporting a reel of film [(9)] having an axis [(9a)] with a generally vertical direction;

mechanical means [(10)] for supporting and guiding the carriage [(8)], which means are carried by the stand [(6)], such that the carriage [(8)] may be displaced in a displacement resulting from the combination of an ascending and/or descending vertical displacement, and of a displacement in a horizontal loop surrounding the load [(2)];

UNITED STATES PATENT AND TRADEMARK OFFICE

CERTIFICATE OF CORRECTION

PATENT NO. : 5,040,359

DATED : August 20, 1991

INVENTOR(S) : Jacques Thimon

It is certified that error appears in the above-identified patent and that said Letters Patent is hereby corrected as shown below:

carriage [(8)]-drive means [(11)] capable of ensuring its effective displacement in an at least substantially helical path, about a vertical axis [(12)], surrounding the load [(2)] with a view to helically banding it with the band of film [(5)];

and, in addition, carried by support means [(26)], a set of means [(25)] comprising:

means for transversely cutting the band of film [(5)], which means are activated at the end of the banding of the load [(2)];

means for temporarily securing the first end part of the band of film [(5)] originating from the reel of film [(9)], which means are active before the beginning of the banding operation;

means for combining the last end part of the band of film [(5)] with the banded load [(2)], which means are active at the end of the banding operation;

and means for controlling and operating the cutting means, the securing means and the combining means;

which support means [(26)] are arranged in order to enable means [(25)] to slide in the vertical direction, wherein it comprises, in addition and in combination:

PATENT NO. : 5,040,359
DATED : August 20, 1991
INVENTOR(S) : Jacques Thimon

It is certified that error appears in the above-identified patent and that said Letters Patent is hereby corrected as shown below:

firstly means [(27)] for deviating in its own plane the band of film [(5)] originating from the reel of film, [(9)] and for vertically offsetting the downstream delivered section [(28)] of the band of film [(5)] with respect to the reel of film [(9)], which means [(27)] are on the one hand carried by the carriage [(8)] at least substantially opposite the reel of film [(9)] and on the other hand may be deformed during the banding operation between two extreme configurations corresponding to two separate extreme states, an active one in which they ensure the deviation and the maximum vertical offsetting and an inactive one in which the deviation and offset are zero or minimal, respectively;

and secondly means [(29)] for controlling and driving the deviating and vertical-offsetting means [(27)] in order to switch them from their active state to their inactive state, or vice versa;

such that in a certain relative situation of the carriage [(8)] during the banding operation, operation of the control and drive means [(29)] results in the downstream delivered

UNITED STATES PATENT OFFICE

CERTIFICATE OF CORRECTION

Patent No. 5,040,359 Dated August 20, 1991

Inventor(s) Jacques Thimon

It is certified that error appears in the above-identified patent and that said Letters Patent is hereby corrected as shown below:

section [(28)] of the band of film [(5)] applied to the load [(2)] being offset relatively in the vertical direction with respect to the reel of film [(9)];

and wherein the support means [(26)] are essentially placed beneath the means [(25)], between the latter and the level of the support table [(7)], which results in the space above the means [(25)] being freed.

Signed and Sealed this

First Day of June, 1993

Attest:

Michael K. Kirk

MICHAEL K. KIRK

Attesting Officer

Acting Commissioner of Patents and Trademarks